United States Patent [19]

Hunke

[11] 4,289,013

[45] Sep. 15, 1981

[54] CROWN CONTROL FOR ROLLING MILL

[75] Inventor: Siegfried H. Hunke, Thomaston, Conn.

[73] Assignee: Textron, Inc., Providence, R.I.

[21] Appl. No.: 70,783

[22] Filed: Aug. 29, 1979

[51] Int. Cl.[3] ..... B21B 29/00; B21B 31/30

[52] U.S. Cl. ..... 72/243

[58] Field of Search ..... 72/243, 242, 241, 244, 72/245

[56] References Cited

U.S. PATENT DOCUMENTS

| | | | |
|---|---|---|---|
| 2,479,974 | 8/1949 | Sendzimir et al. | 72/243 X |
| 3,559,422 | 2/1971 | Rostelli | 72/10 |
| 3,566,638 | 7/1971 | Herbst | 72/8 |
| 3,691,810 | 9/1972 | Sendzimir | 72/243 |
| 4,156,359 | 5/1979 | Verbichas | 72/243 |

*Primary Examiner*—Milton S. Mehr

*Attorney, Agent, or Firm*—DeLio and Montgomery

[57] ABSTRACT

Crown control mechanisms for a cluster rolling mill which includes individually actuated hydraulically driven racks for adjusting in a coordinated manner the positions of backing bearing elements in a manner to counteract work-induced deformation of backing elements and the work rolls.

5 Claims, 7 Drawing Figures

10
11
12
13
14
18
20
21
22
25
26
27
29
30
31
41
42
16c
16f 45
46
47
CROWNS
CHANGE
CH
WK
WORK 10
11
12
13
14
15
16a
16b
16c
16d
16e
16f
16g
16h
20
21
22
25
26
27
II

CROWN CONTROL FOR ROLLING MILL

This invention relates to rolling mills and more particularly to improved apparatus for controlling and limiting work roll deformation by adjustable crown control applied to selected backing rolls. This invention is particularly adaptable for use with cold rolling mills of the Sendzimer type which are widely used for rolling ferrous and non-ferrous metals. Those mills are capable of holding extremely close gage tolerances throughout a wide range.

The rolling mill of the Sendzimer type provides support of the work rolls throughout their length, with controlled resistance to deflection at a plurality of points so that deflection is minimized and very close gage tolerances can be held across the full width of the material being rolled. The roll arrangement in such mills is conventionally a 1-2, 1-2-3 or 1-2-3-4 arrangement, although 1-2-1-4 is sometimes resorted to, as in Rastelli U.S. Pat. No. 3,528,274, Sept. 15, 1970, wherein crown adjustment is effected by means of eccentric rings on the shaft of a segmented backing roll.

In the specification of Sendzimer U.S. Pat. No. 2,194,212, means of adjusting the contour of the rolls (and hence of the roll gap) are disclosed. Such means are incorporated in most modern Sendzimer cluster mills and embody individual drives (so called crown adjustment drives) to each shaft support (saddle) on at least one backing shaft to adjust the position of the shaft at the saddle in a sense to increase or decrease the roll gap in line with the saddle. As there may be from four to eight saddles, or even more, depending on the width of the mill, it is possible to achieve a very fine control of the profile of the roll gap.

In practice it has been found difficult to adjust rapidly and precisely each of the crown adjustment drives, where present, or to make the necessary adjustments manually, if necessary, in order to obtain the fine control of profile which is theoretically possible. This difficulty is largely overcome by the present invention wherein the adjustments are effected simultaneously at each station through controlled hydraulic actuation of the respective eccentrics.

It is accordingly an object of the invention to provide hydraulic cylinder and piston assemblies, each operatively connected to one of the drive means for setting the eccentric support of a backing roll segment at its desired positon.

It is another object of the invention to provide means for effecting crown adjustment from the operator's control panel while the mill is running.

It is a further object of the invention to provide certain improvements in the form, construction and arrangement of the several parts whereby the above-named and other objects may effectively be attained.

The invention accordingly comprises the features of construction, combination of elements, and arrangement of parts which will be exemplified in the construction hereinafter set forth, and the scope of the invention will be indicated in the claims.

A practical embodiment of the invention is shown in the accompanying drawings wherein:

FIG. 1 represents a front view of a roll cluster and housing showing the arrangement of rolls in a 1-2-3-4 mill, including a hydraulic screwdown;

FIG. 1*a* is a diagrammatic representation of a control panel for roll profile adjustment;

Figure 2:
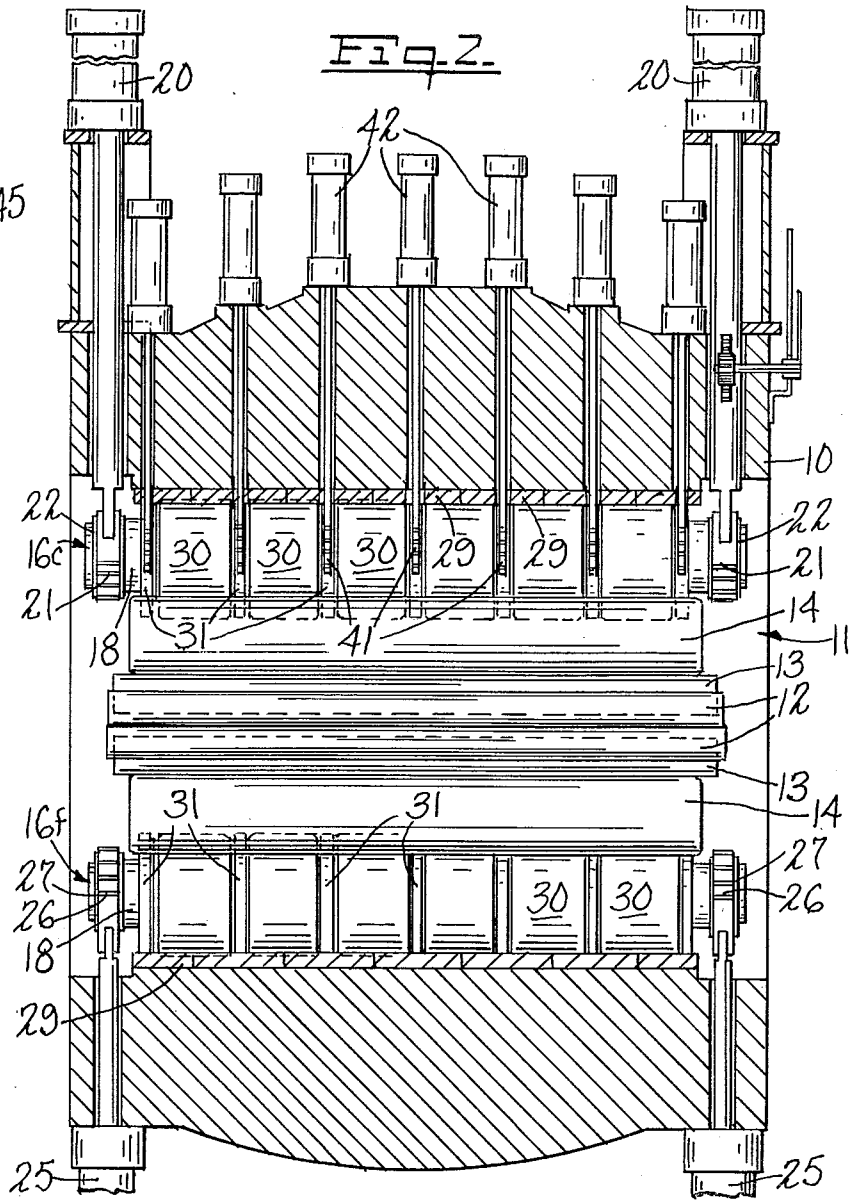
FIG. 2 represents a vertical medial section on the line II-II of FIG. 1 on a larger scale.
Figure 1A:
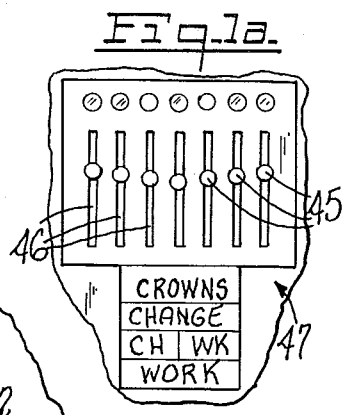
Figure 1:
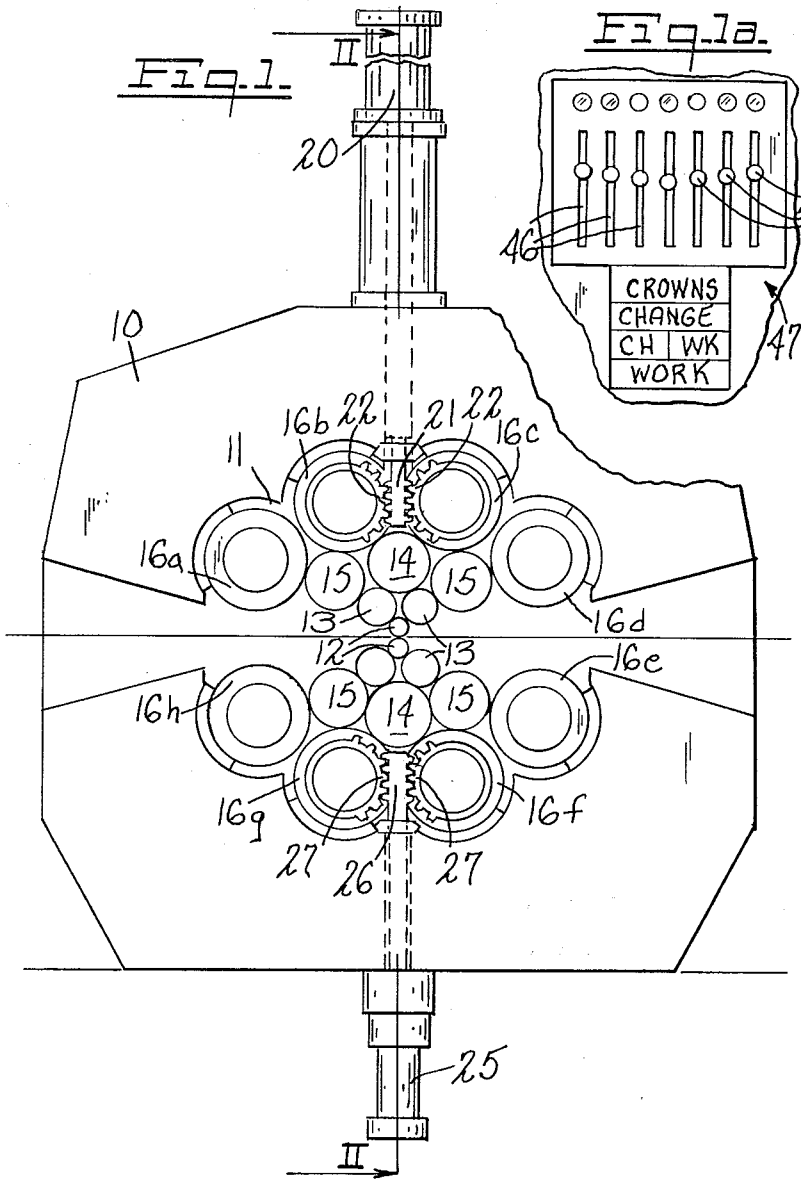
Figure 3:
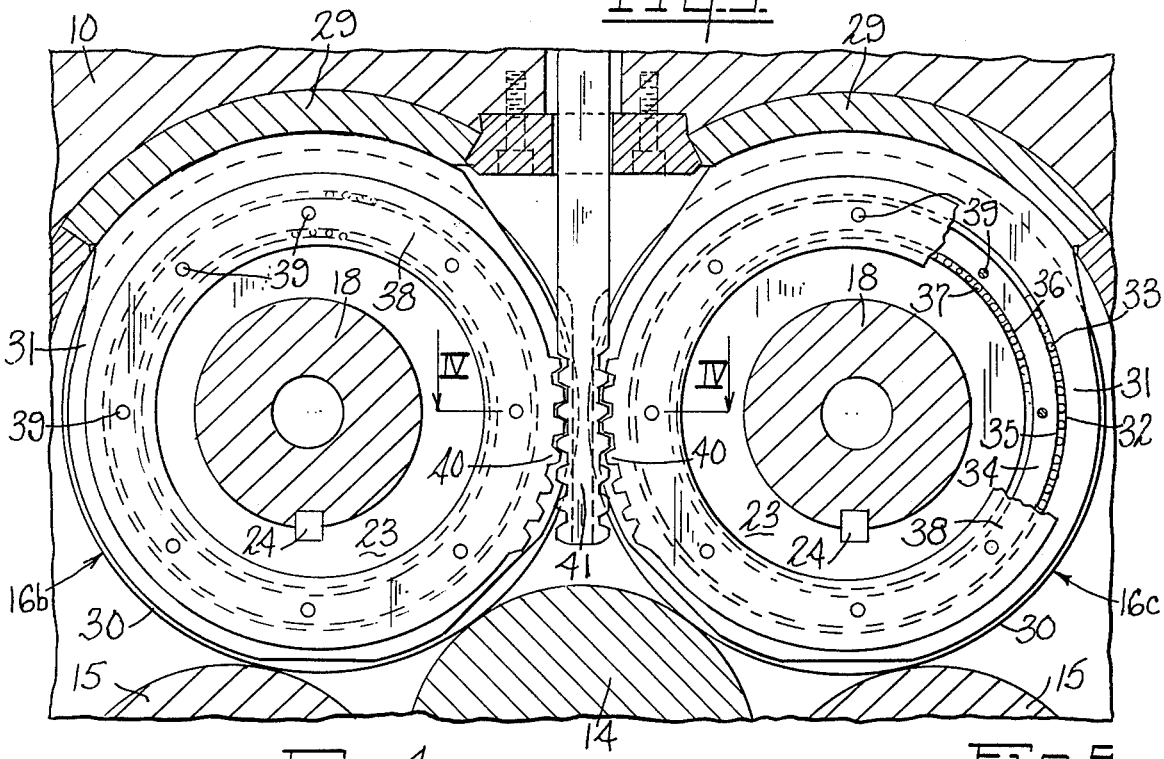
FIG. 3 represents a detail vertical section taken adjacent one of the crown adjustment assemblies, parts being broken away.

Referring to the drawings, the invention is shown as being embodied in a type 1-2-3-4 Sendzimer mill having a housing 10 and roll cavity 11 within which is housed the roll cluster, comprising upper and lower work rolls 12, upper and lower first intermediate rolls 13, upper and lower second intermediate rolls 14 with upper and lower driven intermediate rolls 15 and upper and lower backing bearings 16*a* to 16*h*.

The uppermost adjacent pair of backing bearings, 16*b*, 16*c*, are equipped with screwdown mechanism actuated by hydraulic cylinders 20 which effect positioning of the two upper central shafts 18 by means of racks 21 engaging the teeth of pinions 22 which are fixed at both ends of the shafts. On the shafts are mounted the series of eccentric rings 23, each keyed to the shaft as shown at 24. A hydraulic servo mechanism, not shown, feeds the rack operating cylinders 20 so that they accurately fix and hold the mill opening during rolling to assure constant strip thickness.

The two lower central shafts, in the bearings 16*f* and 16*g*, are similarly positioned by means of cylinders 25 moving racks 26 to rotate pinions 27, on eccentric rings, not shown, to balance the pass line between work rolls by adjusting the position of the lower work roll.

Figure 4:
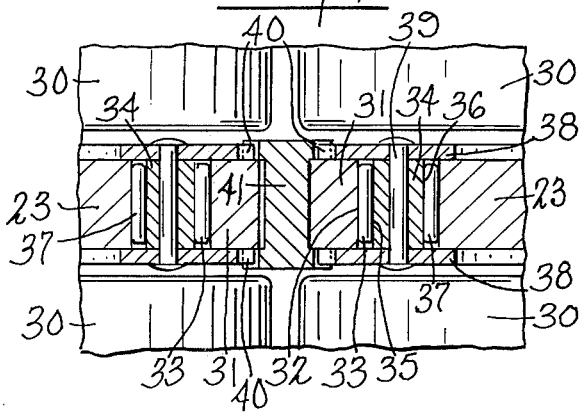
FIG. 4 represents a detail horizontal section on the line IV-IV of FIG. 3, with adjacent portions of backing roll segments.

In addition to screwdown adjustments which determine and stabilize the roll bite, crown adjustments are needed, to counteract work-induced deformation of the work rolls. Such crown adjustments are effected, according to the invention, by hydraulically positioning the additional eccentric rings in which the backing bearing shafts are carried to vary the relation of the shafts to the respective saddles. As shown particularly in FIGS. 3 to 6, each backing bearing comprises a shaft 18 on which are journaled a plurality of bearing roll segments 30 (six being shown). The shaft is supported in the housing by means of saddles 29, each having a projecting flange 31, each formed to constitute an annular outer race 32 for the roller bearings 33. The ring 34 has an annular outer surface 35 which forms the inner race for the bearings 33, and also has an inner annular surface 36, eccentric relative to surface 35, which 1orms the outer race for bearings 37, running on the periphery of eccentric rings 23. The ring 34 is sandwiched between annular plates 38 which are held by bolts or rivets 39 (FIG.4) the plates being provided with teeth 40 adapted to be engaged by the teeth of a rack 41. Each rack 41 (located opposite each flange 31) is actuated by a hydraulic cylinder 42 on the top of the housing, as shown in FIG. 2.

Figure 5:
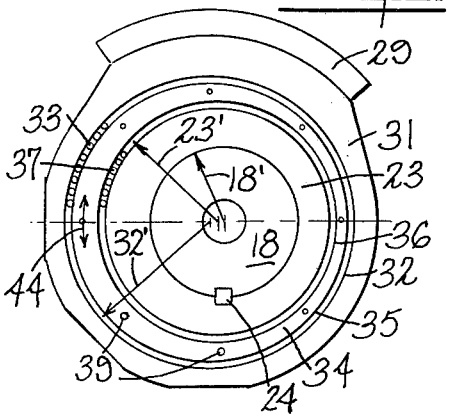
FIG. 5 is an explanatory diagram of the eccentric assembly.
Figure 6:
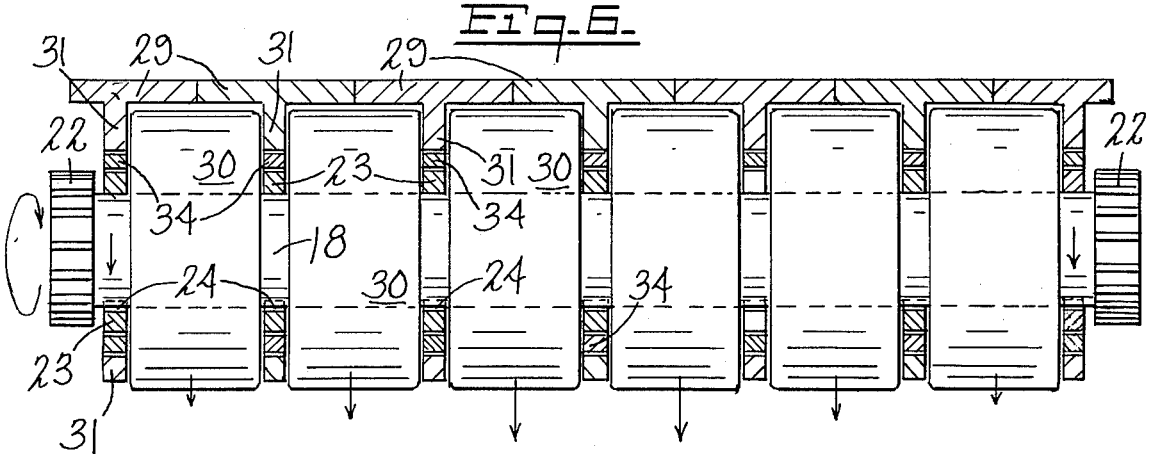
FIG. 6 represents a detail section of the backing roll support system, the segmented backing roll being in full lines.

The geometry of the parts just described is illustrated in FIG. 5 wherein a radius of the shaft 18 is shown at 18', a radius of the periphery of ring 23 is shown at 23' and a radius of the race 32 is shown at 32', the respective centers being as indicated with the parts in the specific adjusted position there shown, and the direction of net movement of the backing roller shaft being toward and away from the foot of the saddle 29, i.e., in the direction of the second intermediate roll 14. A range of arcuate adjustment of the ring 34 (by movement of rack 41) is indicated by the double arrow 44.

The cylinders 42 are adapted to be individually actuated by servo valve mechanisms, not shown, of the type shown and described in Herbst U.S. Pat. No. Re28,248, Nov. 19, 1974, each rack 41 being operatively connected to a lower rod of a Herbst piston and the precise positions of the racks being determined by the settings of the control buttons 45 in their calibrated tracks 46 on the console 47, FIG. l*a*. The backing shaft deflections are substantially magnified in the control button settings so that the operator can see at a glance the general nature of the correction being imposed on the rolls, as well as its exact dimensions, and can make adjustments at any point while the mill is operating.

The screwdown mechanism 20, 21 can also be operated by a separate system, as described in the Herbst patent, the disclosures of which are incorporated herein by reference. An alternative hydraulic screwdown mechanism is described in Rastelli U.S. Pat. No. 3,559,432, showing automatic error detection and correction to effect constant roll gap in mills which are no more than four-high. Herbst disclosed a screwdown for a work roll, while Rastelli operated on the back-up rolls in a four-high mill, not a cluster mill.

As indicated above, applicant's crown control adjustment operates on the two top backing elements **16*b* and 16*c*** and is actuated hydraulically from the operator's desk by push-button control while the mill is rolling.

While shown as applied to a 1–2–1–4 roll arrangement, the hydraulic system can be applied similarly to type 1–2–1–4 and type 1–2 mills, acting in each case on the two top backing elements. Adaptation to other roll arrangements could be arranged.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

What is claimed is:

1. In a mill having a housing, a plurality of work rolls and at least one segmented backing bearing for each work roll, the backing bearing portions being supported on a backing bearing shaft through a plurality of saddles resting against the housing, screw-down mechanism associated with each end of the backing bearing shaft, and crown adjusting means in line with each saddle, each said means comprising:

an eccentric ring between the shaft and the saddle, pinion teeth fixed to said eccentric ring, a rack engageable with said pinion teeth, a hydraulic cylinder and piston mounted on the housing, the piston being operatively connected to the rack, and means for coordinated actuation of said cylinders and pistons.

2. The arrangement of claim 1 which includes a fixed ring on each saddle and an eccentric disc keyed on the shaft in alignment with said fixed ring, the eccentric ring being journaled within the fixed ring and the eccentric disc being journaled within the eccentric ring.

3. The arrangement of claim 2 which includes hydraulic screwdown means operatively engaged with the backing bearing shaft, whereby the angular position of the eccentric disc may be adjusted.

4. The arrangement of claim 1 wherein each eccentric ring is sandwiched between and fixed to a pair of flat annular rings and the pinion teeth are formed on said annular rings.

5. The arrangement of claim 1 wherein the means for coordinated actuation of the cylinders and piston includes a console at the operator's station with individual hydraulic cylinder adjustment elements in calibrated tracks for visual indication of the adjustment pattern.

* * * * *